United States Patent [19]

Knox

[11] Patent Number: 4,777,703

[45] Date of Patent: Oct. 18, 1988

[54] QUICK RELEASE STRAP BUCKLE

[75] Inventor: Howard T. Knox, Simi, Calif.

[73] Assignee: Ancra Corporation, Hawthorne, Calif.

[21] Appl. No.: 884,908

[22] Filed: Jul. 14, 1986

[51] Int. Cl.[4] ..... A44B 11/12

[52] U.S. Cl. ..... 24/71 ST; 24/170; 24/193

[58] Field of Search ..... 24/71 ST, 71 TT, 193, 24/197, 170, 173, 68 CD, 68 E, 311, 313

[56] References Cited

U.S. PATENT DOCUMENTS

| | | | |
|---|---|---|---|
| 951,727 | 3/1910 | Witt et al. | 24/173 |
| 2,369,225 | 2/1945 | George | 24/193 |
| 3,165,802 | 1/1965 | Irvin | 24/197 |
| 3,641,630 | 2/1972 | Farley | 24/193 X |
| 3,852,855 | 12/1974 | Bengtsson | 24/170 X |
| 4,001,920 | 1/1977 | Johnson | 24/193 |
| 4,414,713 | 11/1983 | Prete, Jr. | 24/193 |
| 4,417,372 | 11/1983 | Ronci | 24/197 X |
| 4,564,981 | 1/1986 | Knox | 24/193 X |
| 4,567,628 | 2/1986 | Prete, Jr. et al. | 24/170 X |

FOREIGN PATENT DOCUMENTS

| | | | |
|---|---|---|---|
| 132912 | 10/1919 | United Kingdom | 24/170 |
| 970611 | 9/1964 | United Kingdom | 24/197 |

*Primary Examiner*—Kenneth J. Dorner
*Assistant Examiner*—Laurie K. Cranmer
*Attorney, Agent, or Firm*—Edward A. Sokolski

[57] ABSTRACT

A quick release two piece buckle of economical construction for use in situations where rapid release of a strap is required such as for example a buckle for a strap holding a scuba air tank to a back pack. The buckle has a handle member with a pair of oppositely positioned side arm portions extending therefrom. The arm portions have slots formed on the outer walls thereof, there being a detent at the entry portion of each slot. Detents are further formed on the outer walls of the arms adjacent to the bottoms of each of the slots. One end of the strap is attached to a cross arm extending between the two side arm portions. The other end of the strap is connected to an attachment member which has a pair of opposing arms. Each of the arms has an inwardly extending post member at the end thereof which is adapted to slidably fit into a respective one of the slots of the main body portion. The attachment member is removably connected to the handle member by inserting the post members into the slots, these post members being pushed past the detents at the entrances to the slots. The handle member is then brought down opposite the attachment member, in so doing the arms of the attachment member being snapped past the detents next to the slots of the handle member, the two members thus being joined to each other. The two members can rapidly be released from each other by withdrawing the handle member away from the attachment member to bring the detents on the outer walls of the handle member arm past the attachment member, thereby permitting ready release of the two members from each other.

6 Claims, 2 Drawing Sheets

QUICK RELEASE STRAP BUCKLE

The invention relates to buckles for joining the open ends of straps together and more particularly to such a buckle having a quick release mechanism.

In retaining a scuba tank to a back pack, secure retention of the tank is required when in use while at the same time it is necessary that the tank be readily releasable both in emergency situations and where the tank is to be serviced or refilled with air.

In U.S. Pat. No. 4,414,713, issued Nov. 15, 1983, a quick release buckle of economical construction is described which is along the above indicated lines. The present invention is an improvement over that of the aforementioned patent in affording even greater simplicity and economy without sacrificing the retention or quick release features of this prior art device.

Briefly described, the device of the present invention has a handle member with an operating lever and a main body portion having a pair of opposing arm portions extending therefrom. Running between the arm portions is a cross arm around which one end of a strap is wound, this strap end being retained in a preadjusted position by means of a Velcro fastener. At the end of each arm an outwardly facing slot is formed there being a detent formed at the entrance to each of these slots. These slots are open at one end to form the entrance and closed at the opposite end. Further, a detent is formed on the outer walls of the arms adjacent to the bottoms of the slots. The opposite end of the strap is connected to the cross arm of an attachment member which has a pair of opposing arms with inwardly extending oppositely positioned posts at the free ends thereof. The attachment member is connected to the handle member by inserting the posts of the attachment member into the slots and snapping the posts over the detents at the entrances to the slots and then rotating the handle until it is directly opposite the attachment member, the arms of the attachment members riding over the detents formed adjacent to the slots, the detents tending to retain the operating handle in position. The handle is released from the attachment member merely by rotating the handle away from such attachment member such that the arms of the attachment members ride over the detents below the slots and the posts of the attachment member are free to be slided over the detents at the entrance of the slots to permit detachment of the attachment member from the handle member.

It is therefore an object of this invention to provide an improved buckle of highly simplified and economical construction.

It is a further object of this invention to provide a highly economical two piece buckle suitable for use in attaching a scuba tank to a back pack and which is readily detachable.

Other objects of the invention will become apparent as the description proceeds in connection with the accompanying drawings of which:

Figure 4:
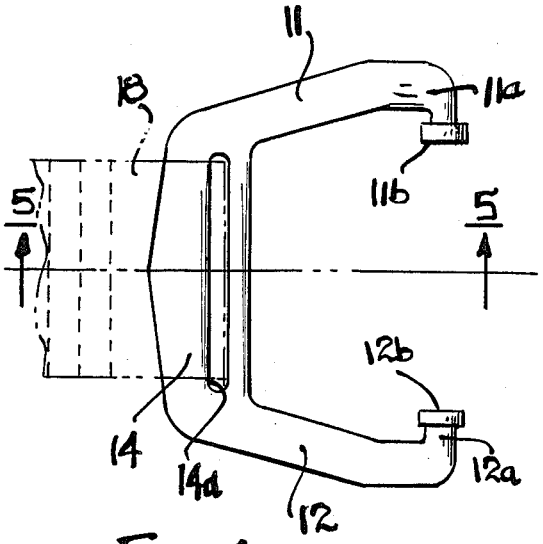
FIG. 4 is a top plan view of the attachment member of the preferred embodiment.
Figure 5:
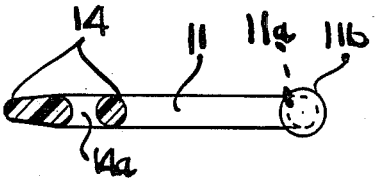
FIG. 5 is a cross sectional view taken along the plane indicated by FIG. 5—5 in FIG. 4.

Referring now to FIGS. 4 and 5 a preferred embodiment of the attachment member of the device of the invention is illustrated. This attachment member comprises a pair of opposing arms 11 and 12 which are joined together at one end thereof by a cross arm 14. Opposing arms 11 and 12 extend outwardly away from each other and have a pair of inwardly extending posts 11*a* and 12*a* on the free ends thereof. Posts 11*a* and 12*a* have round knobs 11*b* and 12*b* at the extreme ends thereof, these knobs being in directly opposing relationship to each other. A slot 14*a* is formed in cross arm 14, one end of strap 18 being run through slot 14*a* and stitched together so that it is atatched to the attachment member.

Figure 6:
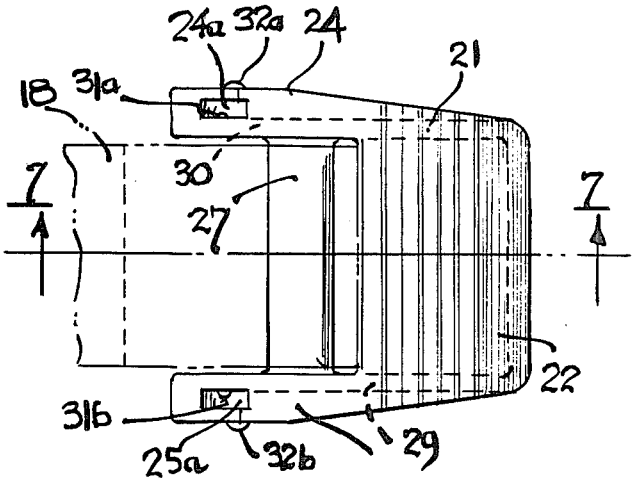
FIG. 6 is a top plane view of the handle member of the preferred embodiment.
Figure 7:
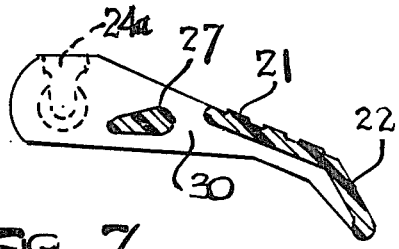
FIG. 7 is a cross sectional view taken along the plane indicated by 7—7 in FIG. 6.
Figure 8:
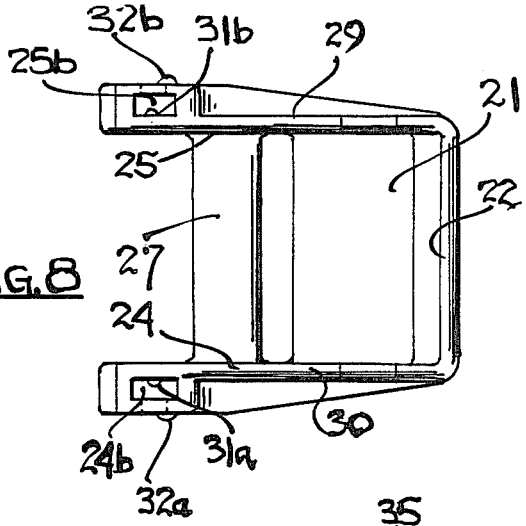
FIG. 8 is a bottom plan view of the handle member of the preferred embodiment.
Figure 9:
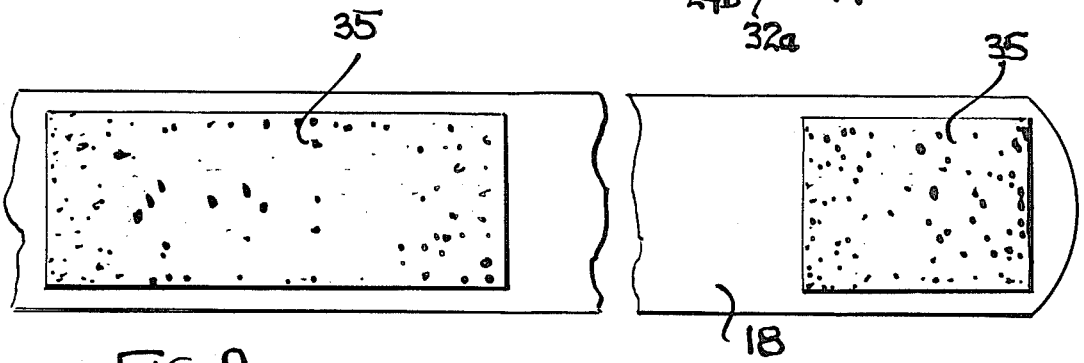
FIG. 9 is a top plan view of a Velcro attachment device which may be employed for adjustably attaching the strap to the handle member of the device of the invention.

Referring now to FIGS. 6 through 8 a preferred embodiment of the handle member of the invention is illustrated. The handle member comprises a main body portion 21 which is generally flat. Lever portion 22 extends angularly from one end of main body portion 21 while a pair of opposing arm portions 24 and 25 extend from the other end of main body portion 21. Cross arm 27 extends between opposing arm portions 24 and 25. Opposing sidewalls 29 and 30 which are indented from the edges of the handle member extend along the entire longitudinal extent of such member. A pair of similar outwardly facing slots 24*a* and 25*a* are formed in arms 25 and 25 respectively near the free ends thereof in opposing relationship. One end of each of these slots is open to form an entrance while the other end is closed. Apertures 24*b* and 25*b* are formed in the bottoms of arms 24 and 25 directly below slots 24*a* and 25*a* respectively. A protuberance 31*a* and 31*b* forming a detent is located in each of the arms at the entrances to the slots. Protuberances 32*a* and 32*b* are formed in the outer walls of each of arms 24 and 25 respectively adjacent to the bottom ends of each of the slots. The other end of strap 18 is wound around cross arm 27 and held in position by means of a Velcro interlocking fabric hooks fastener 35 as shown in FIG. 9, this end of the strap thus being adjustable in length.

Figure 2:
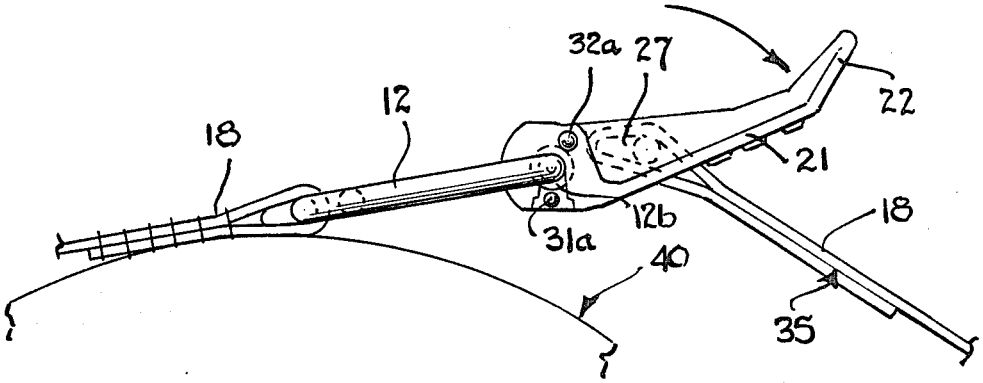
FIG. 2 is a side elevational view of the preferred embodiment showing the device in the process of being detached.
Figure 1:
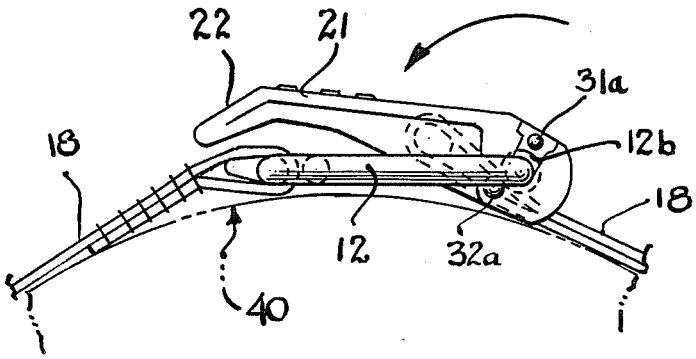
FIG. 1 is a side elevational view of a preferred embodiment of the invention.
Figure 3:
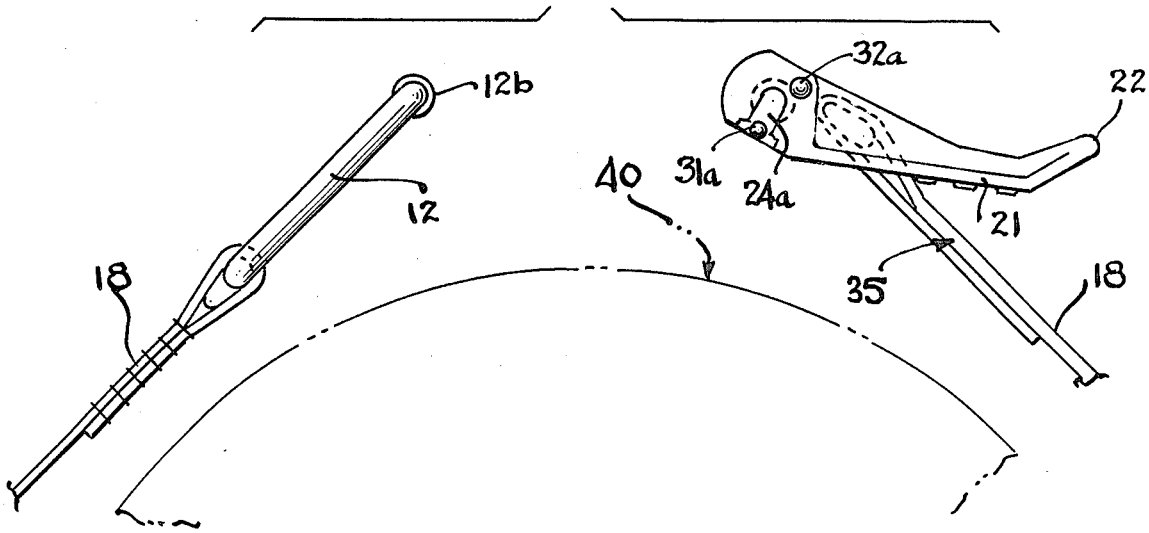
FIG. 3 is a side elevational view of the preferred embodiment shown in an initial position for attachment.

Referring now to FIGS. 1–3, the device of the invention is shown in use in attaching the strap and a back pack or whatever else may be connected to the strap to a tank member 40 which may be a scuba tank. The attachment member and the handle member are first placed in position as shown in FIG. 3 with the open ends of the slots 24*a* and 25*a* facing towards tank 40 and with lever 22 pulled to the right. The knobs 11*b* and 12*b* of arms 11 and 12 are then drawn over detents 31*a* and 31*b* into their respective slots, the arms being resilient and the knobs being spaced apart a distance slightly less than the distance between the two detents such that they snap over the detents into seated positions in the slots with the knobs bottomed in the slots as shown in FIG. 2. Lever 22 is then manipulated as shown in FIG. 1 to bring the handle member opposite the cross arm 14 of the attachment member. In so doing, arms 11 and 12 which are resilient are caused to snap over detents 32*a* and 32*b*, the spacing between these two detents being such that the portions of the arms passing thereover are pushed slightly further apart by the detents and then snapped in position after passing over the detents. In the final attached position as shown in FIG. 1, the arms 11 and 12 are retained in position by means of detents 32*a* and 32*b* while the knob ends 11*b* and 12*b* of posts 11*a* and 12*a* are retained in position by means of detents 31*a* and 31*b*. The buckle can readily be released by merely retracting lever 22 to the position shown in FIG. 2, in which position the knobs can readily be slid out of the slots over detents 31*a* and 31*b*.

While the invention has been described and illustrated in detail it is clearly to be understood that this is intended by way of illustration and example only and is not to be taken by way of limitation, the spirit and scope of the invention being limited only by the terms of the following claims:

I claim:

1. A quick release buckle for removably attaching two strap ends together comprising:

a handle member having a main body portion and a pair of opposing arm portions having outer walls and extending from one end thereof, an outwardly facing slot having open and closed ends formed in each of said arm portions in opposing relationship, first detents being formed in said arm portions at the open ends of each of said slots, said first detents being in opposing relationship and at a predetermined distance from each other, second detents being formed in opposing relationship to each other in the outer walls of said arm portions adjacent to the closed ends of each of said slots, an attachment member including a pair of opposing arms joined together at one end by a cross arm, the opposite ends of said opposing arms having inwardly extending opposing posts with a substantially round knob formed on the extreme ends thereof, said knobs being positioned in opposing relationship at a predetermined distance from each other, means for attaching one of said strap ends to said attachment member, and means for attaching the other of said strap ends to said handle member, the distance between said knobs being slightly less than the distance between said first detents, said handle and attachment members being removably joined together by inserting the knobs in said slots past the first detents and then bringing said handle member past the second detents to a position directly opposite the cross arm of the attachment member, the second detents operating to retain the handle member in said last mentioned position, said handle member being detached from the attachment member by rotating the handle member away from the attachment member such that the arms of the attachment member ridge over said second detents and the knobs are slided over said first detents and out of the said slots.

2. The buckle of claim 1 wherein the means for attaching said one of said strap ends to the attachment member comprises a slot formed in said attachment member cross arm, the strap being run through said slot.

3. The buckle of claim 1 wherein the means of attaching the other of said strap ends to said handle member comprises a cross arm extending between the arm portions of the handle member, the other of said strap ends being wound around said cross arm and having Velcro fastener means thereon for adjustably attaching the other of said strap ends to said cross arm.

4. The buckle of claim 1 wherein the handle member further includes a lever extending from the end of said main body portion opposite to said one end thereof.

5. The buckle of claim 1 wherein the opposing arms of said attachment member run divergently from each other from the cross arm thereof.

6. The buckle of claim 1 wherein the handle member includes opposing side walls indented from the edges thereof and running along substantially the entire longitudinal extent thereof.

* * * * *